US005517717A

United States Patent [19]

Häberli

[11] Patent Number: 5,517,717

[45] Date of Patent: May 21, 1996

[54] SUCTION HEAD FOR A FLOOR CLEANING MACHINE

[75] Inventor: Peter Häberli, Weisslingen, Switzerland

[73] Assignee: Lever Industrial Company, Bridgewater, N.J.

[21] Appl. No.: 204,126

[22] Filed: Mar. 2, 1994

[30] Foreign Application Priority Data

Mar. 4, 1993 [EP] European Pat. Off. ..... 93200628

[51] Int. Cl.[6] ..... A47L 9/00

[52] U.S. Cl. ..... 15/401; 15/245

[58] Field of Search ..... 15/245, 320, 321, 15/322, 401

[56] References Cited

U.S. PATENT DOCUMENTS

| | | | |
|---|---|---|---|
| 1,057,253 | 3/1913 | Matchette | 15/401 |
| 1,088,880 | 3/1914 | Clements | 15/401 |
| 1,145,555 | 7/1915 | Clements | 15/401 |
| 1,628,783 | 5/1927 | Jensen | 15/245 |
| 2,261,475 | 11/1941 | Kautenberg | 15/245 |
| 2,307,460 | 1/1943 | Greisen | 15/245 |
| 2,531,370 | 9/1945 | Thompson . | |
| 2,703,903 | 3/1955 | Faith-Ell | 15/401 |
| 2,703,905 | 3/1955 | Faith-Ell | 15/401 |
| 2,745,126 | 5/1956 | Mora | 15/245 |
| 3,079,623 | 3/1963 | Congdon | 15/401 |
| 3,371,371 | 5/1968 | Steccone . | |
| 3,434,178 | 3/1969 | Dolan . | |
| 4,611,363 | 9/1986 | Samuelsson | 15/245 |
| 5,088,151 | 2/1992 | Legatt . | |

*Primary Examiner*—David Scherbel
*Assistant Examiner*—Randall E. Chin
*Attorney, Agent, or Firm*—A. Kate Huffman

[57] ABSTRACT

There is provided a suction head for a floor cleaning machine, comprising a housing (7) and a package (1) consisting of a squeegee (2) and at least one clip element (3), whereby the size and shape of said clip element and the housing are such that this package can be removably fixed into the housing and that the squeegee (2) can be removably fixed into the clip element (3). When applying this suction head, optimal use can be made of said squeegee.

1 Claim, 2 Drawing Sheets

SUCTION HEAD FOR A FLOOR CLEANING MACHINE

FIELD OF THE INVENTION

The present invention relates to an apparatus for cleaning floor surfaces. The invention is particularly concerned with a suction head arrangement suitable for use with a wet floor cleaning machine.

BACKGROUND OF THE INVENTION

It has been known in the past to employ a mobile suction head as part of a machine for cleaning of floor surfaces, especially a machine for wet cleaning of such surfaces.

U.S. Pat. No 2,531,370 discloses a suction mop suitable for use in scrubbing floors and the like. This suction mop comprises a mop head including a U-shaped channel in which an inverted squeegee blade can be removably supported.

U.S. Pat. No 3,434,178 relates to a vacuum cleaner comprising a vacuum suction nozzle having an inlet near the floor, and an elongate floor brush located near this inlet. This brush is resiliently attached to the vacuum nozzle by way of a U-shaped clip coupled to the nozzle by way of a leaf spring.

U.S. Pat. No 3,371,371 discloses vacuuming equipment for treating floors, in particular a pick-up tool assembly comprising a vacuum head, means for positioning said vacuum head in a fixed functional relationship to the surface to be cleaned, while in use. These positioning means include a non-removable elongate squeegee which is attached to the assembly by a pair of clip elements.

It is an object of the present invention to provide a suction head for a floor cleaning machine, comprising a squeegee which can be easily removed but is, on the other hand, tightly fixed to the rest of the suction head when in It is also an object of the invention that optimal use is made of said squeegee when applied in said suction head.

It has been found that these objects can be achieved by a suction head according to the present invention.

SUMMARY OF THE INVENTION

The present invention provides a suction head for a floor cleaning machine, comprising a housing and a package consisting of a squeegee and at least one clip element, whereby the size and shape of said clip element and the housing are such that this package can be removably fixed into the housing and that the squeegee can be removably fixed into the clip element. The invention also provides a package consisting of a squeegee and at least one clip element which is suitable for use in a suction head according to the invention, whereby the size and shape of the clip element are such that the package can be removably fixed into the housing of the suction head and that the squeegee can be removably fixed into the clip element.

DETAILED DESCRIPTION OF THE INVENTION

The first aspect of the invention is concerned with a suction head for a floor cleaning machine, preferably a wet floor cleaning or floor polishing machine. This suction head comprises a removable package consisting of a removable squeegee and at least one clip element.

In order to be sure of a tight fixation of the package in the suction head, a U-shaped clip element is preferably applied which can be tightly fixed in a similarly shaped channel in the housing of the suction head. For the same reason of tight fixation, this clip element preferably comprises relatively small projections located on the outer surface thereof. After positioning the clip element in the U-shaped channel, these projections will exert an outwardly directed force so as to keep the package tightly fixed.

For obtaining an effective and practical suction head, it is desirable that the housing and the package have an oblong shape and that only one clip element is present in said suction head, whereby this clip element has substantially the same length as the squeegee.

The second aspect of the invention is concerned with a package comprising at least one clip element and a squeegee, whereby the squeegee can be removably fixed into the clip element. For obtaining an effective removable fixation of the squeegee in this respect, it is desirable that the clip element comprises sharp projections on the inner surface thereof.

In view of the construction of the package of the present invention which warrants easy removability of the squeegee, we found that the operating lifetime of the squeegee could be considerably increased when applying an oblong squeegee blade of which all four edges can be used for cleaning purposes. When one of the edges has been worn out, this squeegee does not need to be replaced; it can, instead, be turned along its longitudinal axis after having removed it from the package,such that another edge is applied for cleaning purposes.

The squeegee blade suitable for use in the suction head of the present invention, is preferably somewhat flexible; it is, therefore, desirably made of a plastic material such as polyurethane or rubber. As indicated above, good cleaning results were obtained with a squeegee having an oblong shape; its length and breadth are preferably in the range of respectively 0.6–1.0 m and 0.03–0.05 m. The thickness of the squeegee is effectively in the range of from 3–4 mm.

DETAILED DESCRIPTION OF PREFERRED EMBODIMENTS

Figure 1:
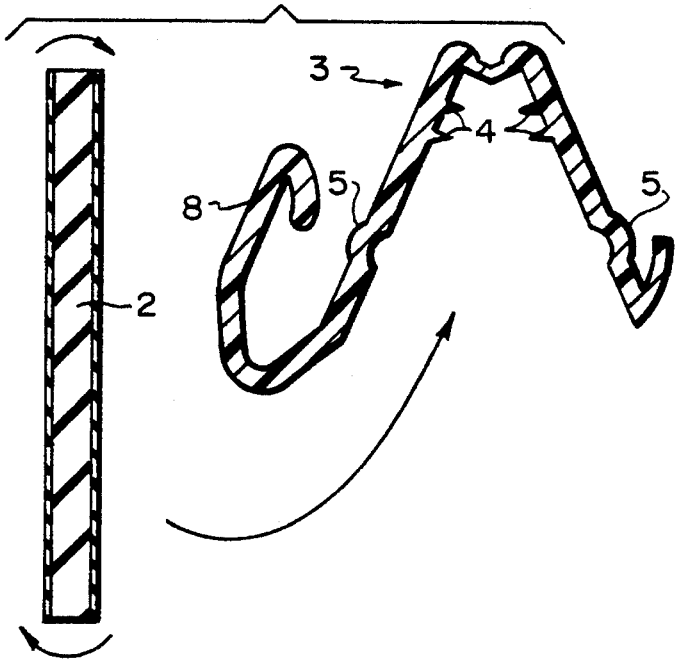
FIG. 1 is a cross-sectional view of the squeegee blade 2 and clip element 3 according to the invention.
Figure 1A:
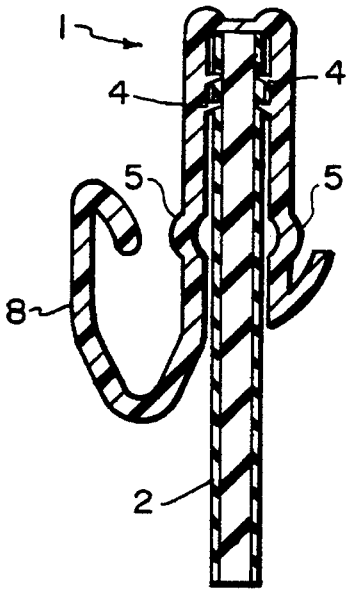
FIG. 1A is cross-sectional view of the squeegee blade 2 inserted into the clip element 3 according to the invention.

Referring now in detail to these drawings, in FIG. 1A (1) indicates a package of the invention consisting of a squeegee blade (2) and a clip element (3). It is also shown in this Figure how the squeegee can be removably fixed into the clip element by way of several sharp projections (4) located on the inner surface of the clip element.

Figure 2:
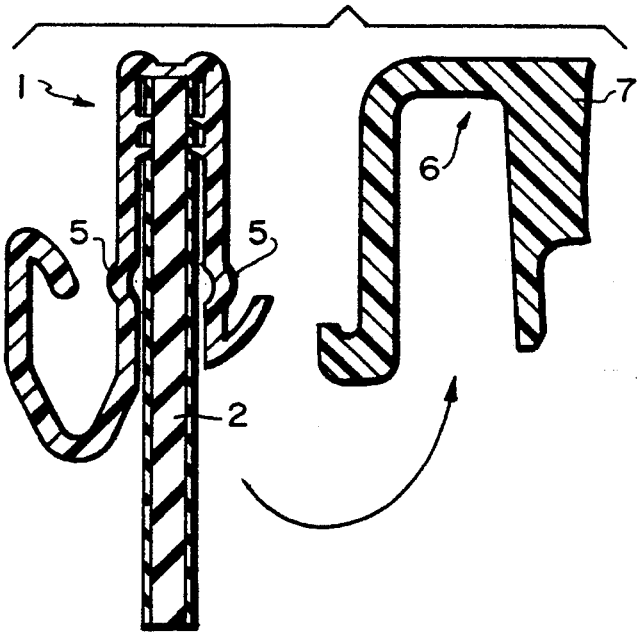
FIG. 2 is a schematic view of the squeegee blade and clip element and the housing 7 according to the invention.
Figure 2A:
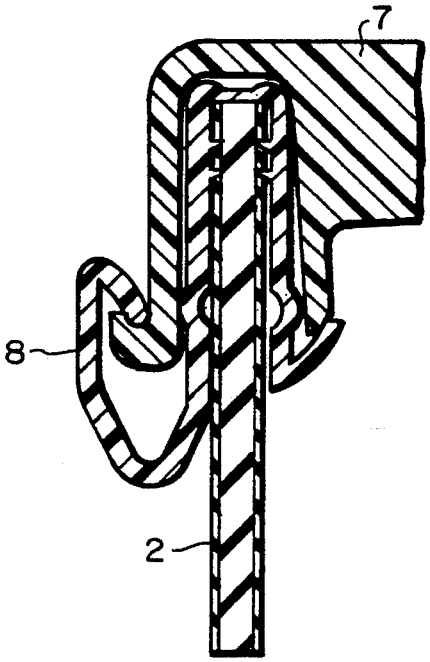
FIG. 2A is a cross-sectional view of the squeegee blade 2 and clip element 3 affixed in the housing 7.

In FIG. 2A, it is shown how the package of the invention (1) can be tightly fixed into the housing (7) of a suction head by way of a U-shaped channel (6). Adequate fixation is accomplished by the outward directed force exerted by the projections (5) located on the outer surface of the package, when this package has been positioned in the U-shaped channel. The fixation of the package into the housing of the suction head can further be improved by applying a clip element having a part (8) which can be attached to the housing as indicated.

Figure 3:
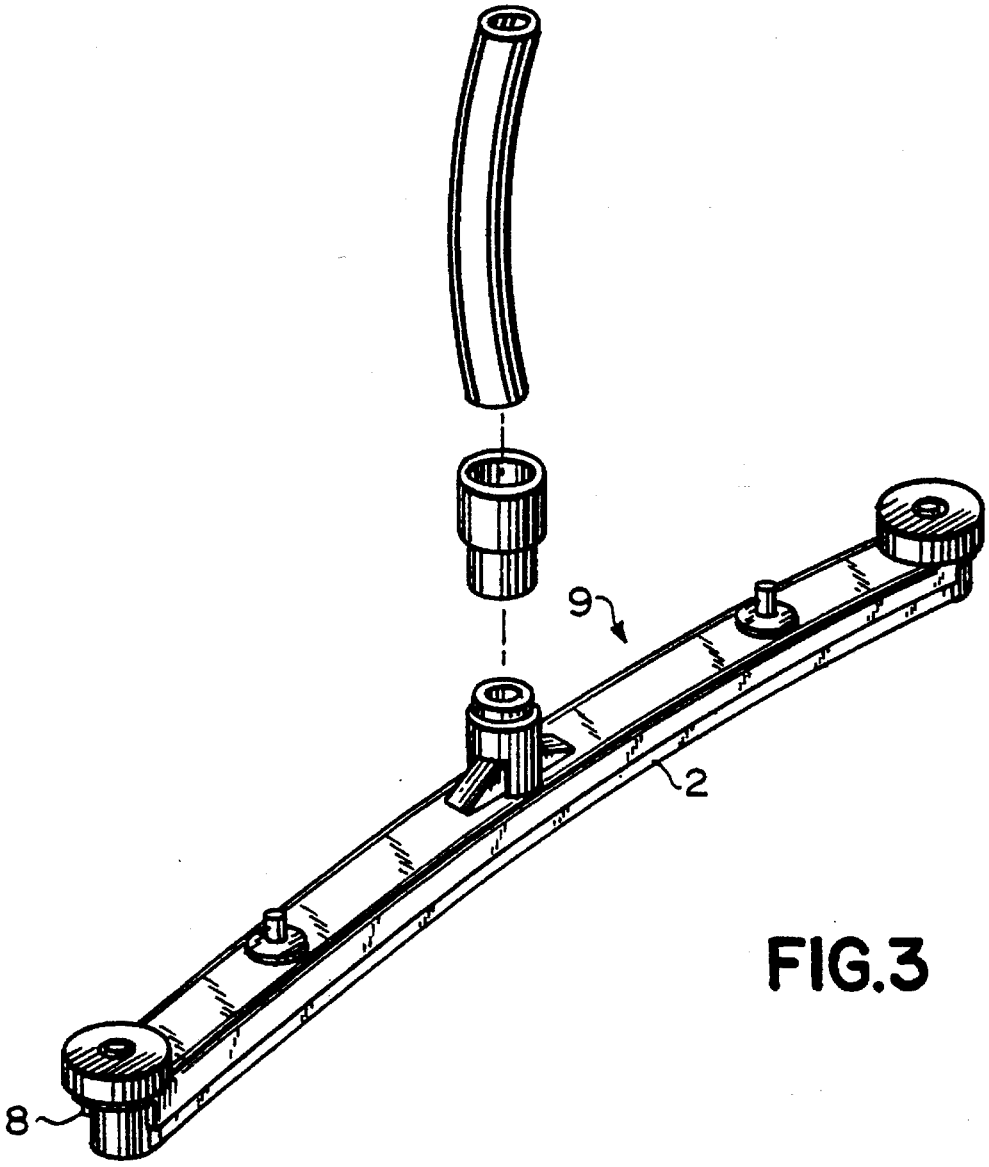
FIG. 3 is a perspective view of the suction head according to the invention.

In FIG. 3, a suction head (9) is shown which can be coupled to any suction system suitable for use in a wet floor cleaning machine.

It is emphasized that the suction head and package shown in the Figures illustrate only one preferred embodiment of the invention and that various constructional alternatives will be immediately evident to the man skilled in the art, without departing from the scope of the present invention.

I claim:

1. A suction head for a floor cleaning machine, comprising:

a housing having an inverted U-shaped channel and a package removably fixed into the housing, said package consisting of a squeegee connected to a clip element, the clip element having a U-shape and having an outer surface with relatively small projections so that the clip element may be fixed into the U-shaped channel of the housing and the projections of the clip element will exert an outward directed force to keep the package tightly fixed when it is in the U-shaped channel of the housing.

* * * * *